US005802015A

United States Patent [19]

Rothschild et al.

[11] Patent Number: 5,802,015

[45] Date of Patent: Sep. 1, 1998

[54] INTELLIGENT LABEL

[75] Inventors: Alan W. Rothschild, Cazenovia; James P. Romano; Richard A. Bozogian, both of Syracuse, all of N.Y.

[73] Assignee: Rothschild Technology, L.L.C., Syracuse, N.Y.

[21] Appl. No.: 851,206

[22] Filed: May 5, 1997

[51] Int. Cl.[6] ..... G04B 47/00; G04B 23/12; F21Q 3/00

[52] U.S. Cl. ..... 368/10; 368/108; 116/202; 116/308

[58] Field of Search ..... 368/10, 107–109; 340/309.15, 309.4; 220/213, 15

[56] References Cited

U.S. PATENT DOCUMENTS

| | | | |
|---|---|---|---|
| 3,249,931 | 5/1966 | Leitton et al. | 340/309.2 |
| 3,811,265 | 5/1974 | Cater | 58/24 R |
| 4,361,408 | 11/1982 | Wirtschafter | 368/10 |
| 4,408,557 | 10/1983 | Bradley et al. | 116/206 |
| 4,490,711 | 12/1984 | Johnston | 340/309.4 |
| 4,504,153 | 3/1985 | Schollmeyer et al. | 368/10 |
| 4,534,012 | 8/1985 | Yokozawa | 364/900 |
| 4,539,632 | 9/1985 | Hansen et al. | 364/143 |
| 4,624,578 | 11/1986 | Green | 368/10 |
| 4,663,621 | 5/1987 | Field et al. | 340/825.31 |
| 4,690,566 | 9/1987 | Robertsen | 368/108 |
| 4,696,576 | 9/1987 | Moore | 368/10 |
| 4,711,368 | 12/1987 | Simons | 220/450 |
| 4,764,715 | 8/1988 | Kowalewski et al. | 320/13 |
| 4,768,176 | 8/1988 | Kehr et al. | 368/10 |
| 4,849,948 | 7/1989 | Davis et al. | 368/10 |
| 5,058,088 | 10/1991 | Haas et al. | 368/327 |
| 5,107,469 | 4/1992 | Dodson | 368/109 |
| 5,182,212 | 1/1993 | Jalinski | 436/2 |
| 5,243,579 | 9/1993 | Potthof | 368/107 |
| 5,327,115 | 7/1994 | Swierczek | 340/309.15 |
| 5,328,597 | 7/1994 | Boldt, Jr. et al. | 210/87 |
| 5,442,669 | 8/1995 | Medin | 377/20 |
| 5,446,705 | 8/1995 | Haas et al. | 368/327 |
| 5,487,276 | 1/1996 | Namisniak et al. | 62/125 |
| 5,528,563 | 6/1996 | Tothill et al. | 368/327 |
| 5,555,223 | 9/1996 | Barainsky | 368/10 |
| 5,589,812 | 12/1996 | Jones | 340/309.15 |

*Primary Examiner*—Vit W. Miska
*Attorney, Agent, or Firm*—Trapani & Molldrem

[57] ABSTRACT

An electronic timing label for indicating the expiration of a time period associated with a particular article. The label comprises a pulse generator and a binary counter. The pulse generator is configured to generate a series of pulses at a predetermined pulse rate, and the counter is configured to count from an initial count number in response to the series of pulses and to generate an expiration signal upon reaching a final count number. The number of counts between the initial and final count numbers, and the pulse rate, are chosen to establish a counting time for the counter which corresponds to the time period associated with the article. The label also comprises a display for indicating the expiration of the time period, a programming port for directing programming pulses to the counter, and some mechanism for affixing the label to an application surface associated with the article.

16 Claims, 4 Drawing Sheets

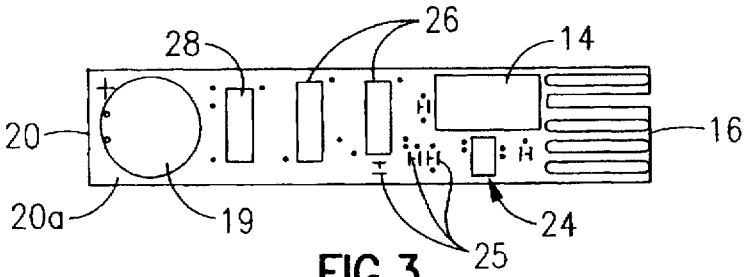
FIG.3
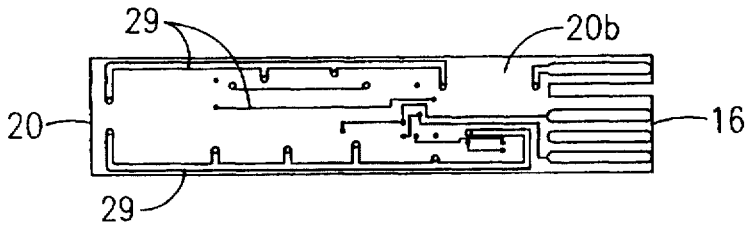
FIG.4
FIG.5
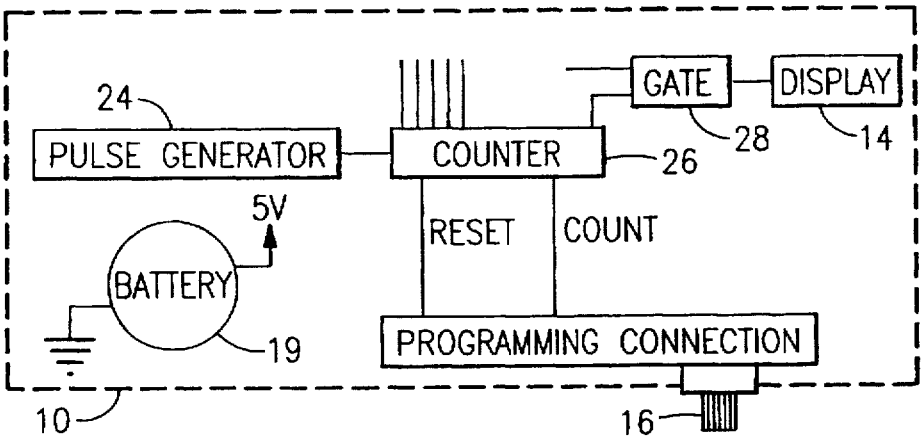
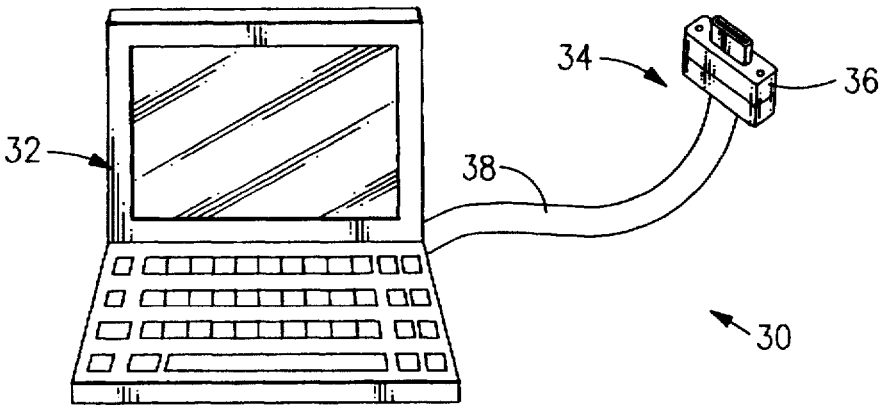

INTELLIGENT LABEL

BACKGROUND OF THE INVENTION

1. Technical Field

The present invention relates generally to time indicators, and more particularly to electronic and programmable labels or stickers which monitor and indicate the expiration of a predetermined period of time.

2. Background Art

In certain industries, it is desirable to keep track of a predetermined period of time and to note the expiration date of that period. For example, in the food and drug industries, the period of time is the shelf-life of a perishable product, and its expiration date is required to be labeled on the packaging of such product. In maintenance service industries, such as equipment or automobile servicing, the time period between scheduled maintenance is advantageously monitored, and the date of the next scheduled maintenance is usually noted on a label affixed to the article to be maintained.

The chief problem with conventional labeling systems is that one must constantly monitor the labels for the expiration dates. Many times the dates are missed because of a lack of diligence in monitoring the product labels. In pharmacies, for example, the pharmacist or pharmacy technician must periodically check the labels on many drug bottles stored on the shelves in the pharmacy, for expiration dates. This practice is tedious and time consuming, and distracts the pharmacist from his or her primary responsibility, i.e., serving the customer.

The consequences of missing a labeled expiration date can be dangerous and expensive. For example, if a pharmacist dispenses a drug that has an expired shelf-life, the drug may no longer be effective, and the patient may suffer as a result. Equipment which continues to operate beyond its scheduled maintenance date may fail and require expensive repair or replacement.

Calendaring or docketing systems have been devised to track expiration dates of various articles. With the advent of computers, such systems have become more prevalent. However, the data in such systems must be constantly updated and maintained, otherwise the output from such systems becomes unreliable. In some applications, such as pharmacy operations, it would be a tremendous burden to constantly update and maintain a system for tracking expiration dates for every drug in inventory.

As an alternative to calendaring systems, others have directed their attention to improving conventional label systems. For some time now, the idea has been known that if a label could provide some visual signal that the expiration date has been reached, the burden of monitoring time-sensitive or perishable inventory could be reduced. For example, U.S. Pat. No. 4,408,557 to Bradley et al. discloses a timer and storage condition indicator configured as a label to be affixed to a medicine bottle. Once the shelf-life of the medicine in the bottle has expired, the word "Expired" appears on the label. This is accomplished by use of a particular carrier liquid and black dye. The timing function is achieved by a predetermined migration rate (or "wicking") of the carrier liquid through a porous material. Similar dye or chemically activated indicator labels are disclosed in U.S. Pat. No. 5,058,088 to Haas et al.; U.S. Pat. No. 5,182,212 to Jalinski; and U.S. Pat. No. 5,446,705 to Haas et al.

These dye or chemically activated labels suffer from the drawback that they must be redesigned for each different period to be timed. In addition, the timing periods disclosed for these labels are from a few days to only about two years. Moreover, these types of labels are sensitive to temperature, which could adversely affect the accuracy of their timing function. Furthermore, the expiration message revealed by some of these labels becomes blurred and difficult to read because of over-migration of dyes, inks, etc.

The present invention was conceived to overcome the above-mentioned drawbacks associated with dye and chemically activated labels. The present invention concerns an electronic timing label which can be programmed to time a wide range of different time periods. To be practical, the design of such a device must satisfy the following criteria: (1) be relatively inexpensive (e.g., less than $1.00); (2) have a relatively small size; (3) have very low power consumption; (4) have the capability of timing long periods of time (e.g., greater than 2 years); (5) provide an easily perceptible expiration signal; and (6) be programmable.

Electronic programmable timing devices have been developed for various applications. For example, U.S. Pat. No. 5,487,276 to Namisniak et al. discloses a food inventory device which utilizes a microprocessor to time the storage life of food in a refrigerator. The device is affixed to the outside surface of the refrigerator door. As an other example, a programmable maintenance timer system is disclosed in U.S. Pat. No. 4,539,632 to Hansen et al. This timer also utilizes a microprocessor to program a time interval to be counted down before the next maintenance service is to be performed. Other examples of such electronic timers are disclosed in U.S. Pat. No. 5,327,115 to Swierczek and U.S. Pat. No. 4,663,621 to Field et al.

None of these electronic timing devices satisfies all of the above-mentioned design criteria for a practical embodiment of the electronic label of the present invention. In particular, all of the devices disclosed in the above-cited patents are relatively expensive, in that they require microprocessors or extensive logic circuitry and other electronic components. The power consumption requirements for these devices are too great to permit a very small battery to power them for extended periods of time (e.g., greater than two years). Finally, the size of these devices are not small enough (due to the number of components and use of microprocessors) to be practical for a small label embodiment as contemplated by the present invention.

OBJECTS AND SUMMARY OF THE INVENTION

It is therefore an object of the present invention to provide an electronic timing label that avoids the aforementioned problems associated with the prior art.

It is another object of the present invention to provide an electronic timing label that is relatively inexpensive, making it economically feasible for widespread use.

It is a further object of the present invention to provide an electronic timing label that has a relatively small size such that it is practical for many labeling applications.

It is still another object of the present invention to provide an electronic timing label that can time periods in excess of two years.

It is still a further object of the present invention to provide an electronic timing label with relatively low power consumption, such that periods in excess of two years can be timed with a single battery.

It is still a further object of the present invention to provide an electronic timing label the design of which remains constant for different timing applications.

It is yet another object of the present invention to provide an electronic timing label that is easily programmed to time a wide range of different time periods.

It is yet a further object of the present invention to provide an electronic timing label that communicates a clear and conspicuous expiration message or signal.

It is yet still another object of the present invention to provide an electronic timing label that accurately times a predetermined time period.

It is yet still a further object of the present invention to provide an electronic timing label the accuracy of which is not adversely affected over a wide range of temperatures.

These and other objects are attained in accordance with the present invention, wherein there is provided an electronic timing label for indicating the expiration of a time period associated with an article. The label comprises a mount, a pulse generator mounted to the mount, and a binary counter mounted to the mount. The mount is preferably a printed circuit board. The pulse generator is configured to generate a series of pulses at a predetermined pulse rate. The binary counter is operatively coupled to receive the series of pulses from the pulse generator. The counter is configured to count, from an initial count number, in response to the series of pulses, and to generate an expiration signal upon reaching a final count number. The number of counts between the initial and final count numbers, and the pulse rate, are chosen to establish a counting time for the counter which corresponds to the time period associated with the article.

The electronic timing label also comprises an indicator device, operatively coupled to the counter, for indicating the expiration of the time period in response to the expiration signal generated by the counter. A programming port is operatively coupled to the counter, and functions to direct programming pulses to the counter. An attachment mechanism, such as permanent adhesive or double-side foam tape, is also provided for affixing the electronic timing label to an application surface associated with the article. The application surface may be a surface of the article itself or some other surface adjacent to or otherwise associated with the article.

The label may further comprise a cover mounted to the mount (or printed circuit board). The cover is positioned, configured and dimensioned to enclose the pulse generator and binary counter on the label. A battery is the preferred power source for the electronic label. A battery is secured to the mount and operatively coupled to the pulse generator and binary counter. In a preferred small embodiment of the electronic label, the pulse generator, binary counter, indicator device, programming port, and battery are all contained within a volume not exceeding about 1 cubic inch, and the mount or printed circuit board is not more than about 1.5 square inches.

It is also preferred that the indicator device be an electronic display device, such as an LED or a liquid crystal display. The electronic label may also comprise a device or circuit for energizing the display in a periodic manner, such that the display is made to blink on and off periodically upon expiration of the time period associated with the article.

An electronic label system is also contemplated by the present invention. The system includes the electronic label itself, and further includes a programming unit, and an interface to connect the programming unit to the electronic label. The programming unit is configured to program the binary counter in the label. The programming unit generates programming pulses for setting the binary counter to the initial count number. The interface is configured to be coupled between the programming unit and the programming port of the label. Programming pulses from the programming unit pass through the interface, and through the programming port of the label, and are received by the binary counter. The pulses cause the counter to count to the initial count number.

A method of monitoring the shelf-life of a perishable product is also contemplated by the present invention. The method comprises the steps of: (1) affixing an electronic timing label to an application surface associated with the product, the label including a timer and an electronic display; (2) timing the shelf-life of the product with the timer of the label; (3) generating an expiration signal upon the expiration of the shelf-life; and (4) visually indicating the expiration of the shelf-life with the electronic display. The method may further comprise the step of: (5) energizing the electronic display in a periodic manner in response to the expiration signal, such that the display device is made to blink on and off periodically upon expiration of the shelf-life.

BRIEF DESCRIPTION OF THE DRAWING

Further objects of the present invention will become apparent from the following description of the preferred embodiment with reference to the accompanying drawing, in which:

FIG. 3 is a top plan view of a printed circuit board of the electronic timing label shown in FIG. 1;

FIG. 4 is a bottom plan view of the printed circuit board of FIG. 3;

FIG. 5 is a block diagram of the electronic timing label system of the present invention;

DETAILED DESCRIPTION OF THE PREFERRED EMBODIMENT

Figure 1:
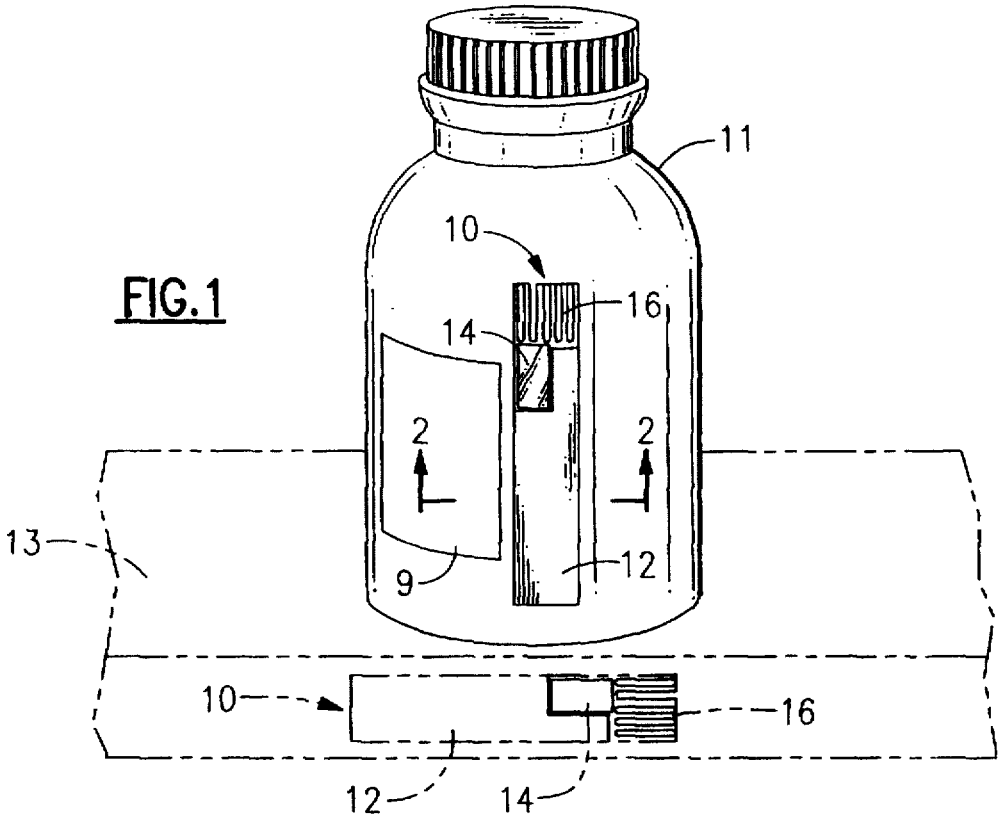
FIG. 1 is a perspective view of a pharmaceutical bottle containing an electronic timing label of the present invention, and showing a shelf as an alternative application surface for the label.

With reference to FIG. 1, there is shown an electronic timing label 10 constructed in accordance with the present invention. Label 10 is affixed by means of an adhesive to a pharmaceutical bottle 11, to illustrate one example of how label 10 can be used. As viewed from FIG. 1, label 10 includes a cover 12, an electronic output device 14, and a programming connector port 16. Bottle 11 is shown resting on a shelf 13. The surface to which label 10 is affixed is referred to as the "application surface." As illustrated in FIG. 1, the application surface associated with bottle 11 may be, for example, the surface of the bottle itself or the front surface of shelf 13.

In the application illustrated in FIG. 1, label 10 is employed to monitor the shelf-life of the medication contained in bottle 11, and to indicate when the shelf-life has expired. The shelf-life is a time period associated with bottle 11.

Figure 2:
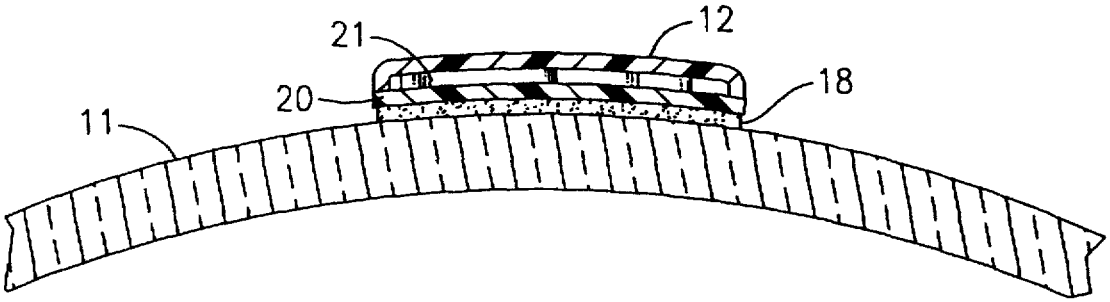
FIG. 2 is a cross-sectional view of the pharmaceutical bottle of FIG. 1, taken along line 2—2 in FIG. 1.

FIG. 2 is a cross-sectional view of label 10, taken along line 2—2 in FIG. 1. As shown in FIG. 2, label 10 is affixed to bottle 11 by means of a piece of double-sided foam tape 18. Any means of affixing label 10 to an application surface may be used. The following are examples of such affixing means: a suitable permanent adhesive; magnets in appropriate circumstances; a band or strap wrapped around an application surface (e.g., bottle); hook and loop fasteners; hooks; clips; static cling film; and electret film.

As shown in FIG. 2, one side of tape 18 is adhered to the back surface of a mount or substrate 20. In the preferred embodiment, mount 20 is a printed circuit board on which the electronic components of label 10 are mounted. Cover 12 is also mounted to board 20, and this assembly forms a space 21 in which the electronic components of label 10 are enclosed.

Figure 7:
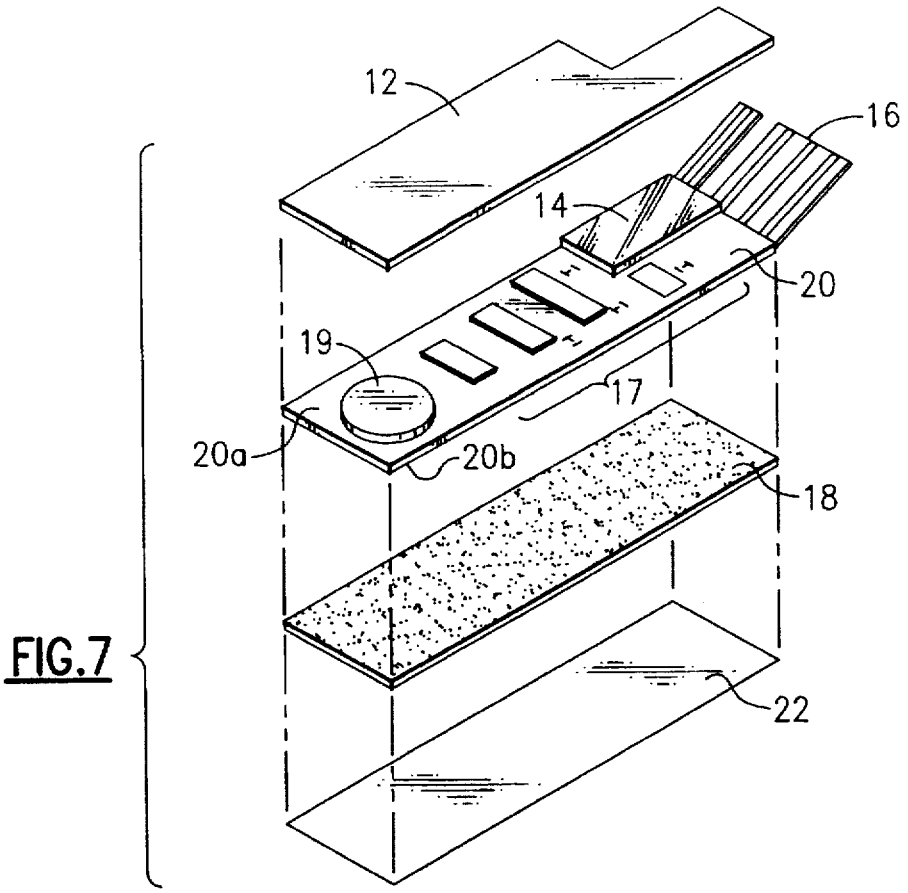
FIG. 7 is an exploded perspective view of the electronic timing label of the present invention.

An exploded view of the construction of label 10 is shown in FIG. 7. Cover 12 is fastened to circuit board 20 by means of an adhesive or fasteners. A number of circuit components 17, a battery 19, and electronic output 14 (described in greater detail hereinbelow) are mounted to a front mounting surface 20*a* of circuit board 20. Programming port 16 comprises a set of parallel disposed conductor strips printed on circuit board 20. As shown in FIG. 7, one side of double-sided tape 18 is affixed to a rear mounting surface 20*b* of circuit board 20 (hidden, in FIG. 7). The other side of tape 18 is reserved for attachment to an application surface when label 10 is put into service, and this other side is protected by a peel-a-way wax-paper strip 22.

Referring now to FIGS. 3 and 4, there is shown the mechanical layouts of printed circuit board 20. The layout of front surface 20*a* is shown in FIG. 3, and the layout of rear surface 20*b* is shown in FIG. 4. Mounted to front surface 20*a* is electronic output device 14, battery 19, and the other electrical components of label 10. These other electrical components include a pulse generator 24, a 24 bit binary counter 26 (two twelve-bit stages), and a logic gate 28. Three resistors and two capacitors (not shown in FIG. 3) form part of the pulse generator circuit, and are also mounted on surface 20*a*, at locations 25. The circuit in which all of these components are connected will be described hereinbelow with reference to FIGS. 5 and 6.

As shown in FIG. 4, electrical conductors 29 are printed on rear surface 20*b* in a manner well known in the printed circuit board art. Conductors 29 are arranged to complete an electrical circuit between output device 14, programming port 16, battery 19, generator circuit 24, binary counter 26, and logic gate 28.

In a small embodiment of label 10, the area of the front and rear surfaces of board 20 should not be more than 3 square inches, and preferably should not be more than about 1.5 square inches. These size specifications have been determine for label embodiments intended for typically sized containers or packaging. Consistent with these size requirements, the entire label construction, including board 20, output device 14, programming port 16, battery 19, pulse generator circuit 24, binary counter 26, and logic gate 28, should be contained within a volume not exceeding 1.5 cubic inches, and preferably within a volume of not more than about 1 cubic inch.

As best understood from FIGS. 2 and 7, cover 12 is positioned, configured and dimensioned to enclose battery 19, pulse generator circuit 24, binary counter 26, and logic gate 28. An alternative cover to cover 12, is a plastic foam or gel coating (opaque, translucent or transparent) applied over battery 19, pulse generator circuit 24, binary counter 26, and logic gate 28. In a most basic embodiment of the present invention, a cover can be dispensed with.

It is envisioned that the circuitry for label 10 be realized in a single chip, as an Application Specific Integrated Circuit (ASIC). Pulse generator 24, binary counter 26, gate 28, and at least some of the resistors and capacitors would be implemented on a single ASIC. This will reduce the parts count for label 10 to one chip, one capacitor, two resistors and a battery. It may also be possible to make output device 14 an integral part of the ASIC. It is believed that the current consumption of the ASIC chip, as herein described, would only be slightly greater than the current consumption of a discrete form of pulse generator 24 or binary counter 26. Thus, the ASIC implementation of the present invention is preferred for label applications requiring a very small battery cell and long duration timing (e.g., 6 years).

Referring now to FIG. 5, there is shown an electronic label system 30 configured in accordance with the present invention. System 30 includes electronic timing label 10, a programming unit 32, and a programming interface 34. Programming unit 32 may be an appropriately programmed personal computer ("PC"), but it does not need to be that complex. Unit 32 merely needs to be capable of generating a predetermined number of pulses which are electrically compatible with binary counter 26. A computer program for programming a PC to generate a predetermine number of pulses at the PC's printer port is disclosed below.

As shown in FIG. 5, interface 34 includes a connector 36 and a cable 38. Interface 34 provides an electrical interface between unit 32 and electronic timing label 10. Cable 38 is electrically connected to unit 32 such that programming pulses from unit 32 can be transmitted to and over cable 38. Connector 36 provides a mechanical and an electrical connection between cable 38 and programming port 16 of label 10. Connector 36 is configured to mate securely with port 16, or vice versa. Interface 34 may simply be a standard PC printer cable connected to a printer port located on programming unit 32.

The function of programming unit 32 is to program counter 26 in label 10. Unit 32 does this by sending a predetermined number of programming pulses to counter 26. The programming pulses are generated by unit 32, and transmitted over interface 34 to port 16 of label 10. The pulses are then received by counter 26, causing counter 26 to count to a predetermined initial count number. This operation will be further described hereinbelow with reference to FIG. 6.

Figure 6:
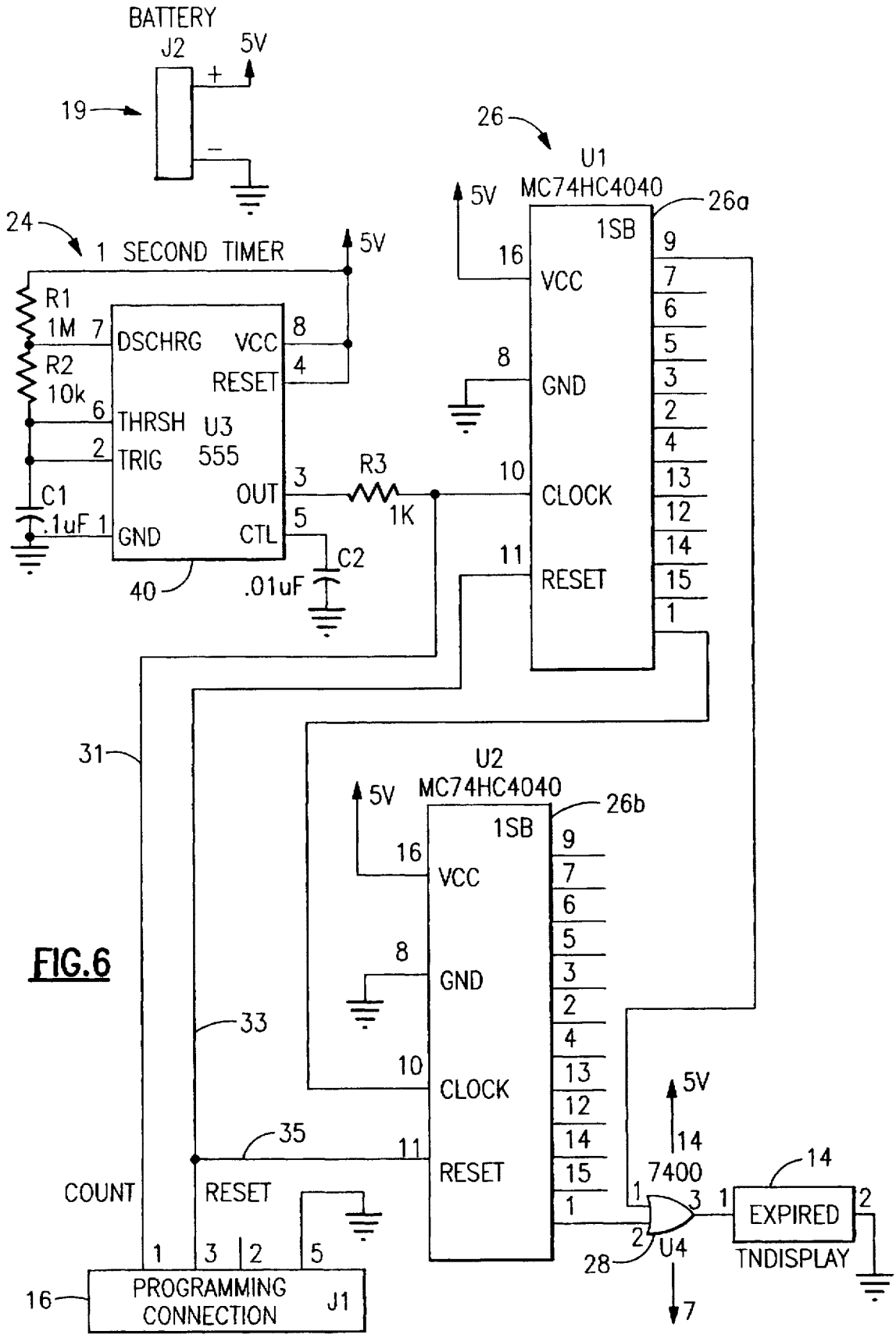
FIG. 6 is a schematic diagram of the electronic timing label of the present invention.

Referring now to FIG. 6, the details of the electrical components and circuitry of label 10 will now be described. As shown, label 10 includes output device 14, programming port 16, battery 19, pulse generator circuit 24, two-stage binary counter 26, and logic gate 28. Battery 19 may be a lithium or silver oxide button cell, both of which are available in a preferred ½ inch diameter size. As an example, pulse generator circuit 24 may utilize a commercial standard Texas Instruments CMOS TLC555C timer chip 40. The TLC555C chip was selected for its low quiescent current draw (i.e., 15–100 microamps), long duration timing capability, and low cost. Timer chip 40 is configured as an astable multivibrator (i.e., a free running pulse generator). Pulse generator circuit 24 also includes resistors R1, R2 and capacitors C1, C2. The sum of resistors R1, R2, and the value of capacitor C1, determine the pulse rate of the pulses generated by generator 24. The ratio of resistors R1, R2 determines the pulse width of the pulses generated by generator 24. A wide pulse width might be desirable if the output device of label 10 is, e.g., a TN liquid crystal display, whereas a narrow pulse would be better if the output device is an LED. When using an LED as the output device, a narrow pulse (i.e., LED on-time) will save considerable power. Circuit 24 is powered by battery 19.

The output of pulse generator circuit 24 is a series of pulses at a predetermined pulse rate and pulse width. This output appears at an output pin 3 of chip 40. The output passes through a resistor R3 and is applied to the clock input of a first counter 26*a* of binary counter 26. In the embodiment shown in FIG. 6, counter 26 is a 24 bit binary counter made up of two 12 bit counters 26*a* and 26*b*. Counters 26*a* and 26*b* are standard binary counters (e.g,, Motorola MC74HC4040 chips) which increment a binary count each time a pulse is applied to their respective clock inputs (pin 10). Since each input pulse occurs at a predetermined interval (e.g., 20 seconds), a real time delay can be monitored. Counters 26*a* and 26*b* are asynchronously connected, in that the most significant bit (MSB) output of counter 26*a* (pin 1) is directly connected to the clock input (pin 10) of counter 26*b*. Counters 26*a* and 26*b* are each powered by battery 19.

In setting up counter 26, a predetermined initial count number and a final count number are determined for counter 26. The number of binary counts between the initial and final count numbers, and the pulse rate of the pulses from generator 24, establish a counting time (or timing period) for counter 26. This timing period is set to correspond to the time period (e.g., shelf-life) to be timed by label 10. To set counter 26 to the initial count number, it must be pre-loaded (or programmed) with a predetermined number of programming pulses, which are obtained from programming unit 32. As shown in FIG. 6, the programming pulses are received on pin 1 of programming port 16, and are directed along a conductor 31 to the clock input (pin 10) of counter 26*a*. Once counter 26 is set to the initial count number, it is ready to count to the final count number. The final count number depends on the particular output device 14 used in label 10.

Figure 8:
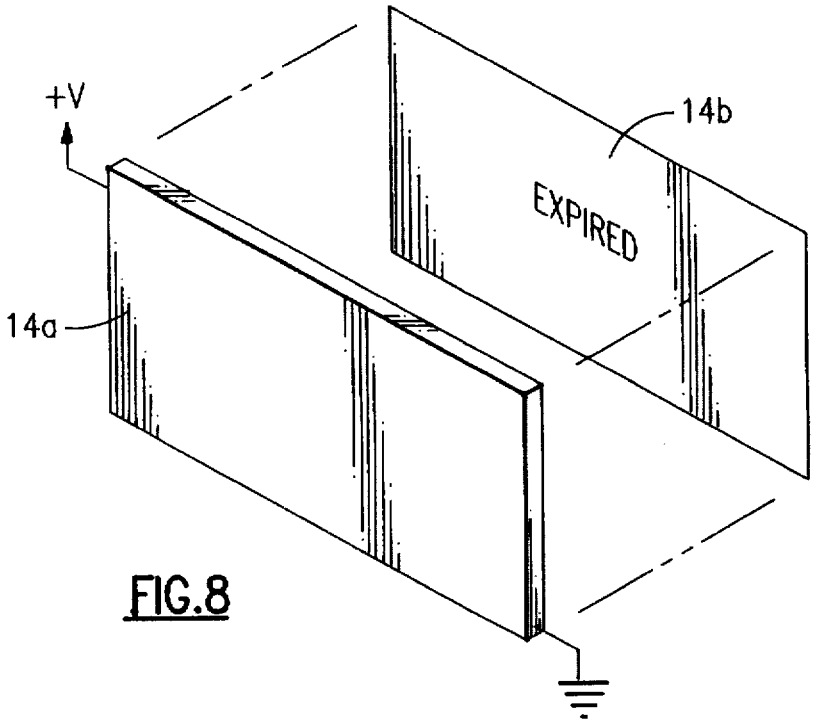
FIG. 8 is an exploded diagrammatic view of a TN liquid crystal display and background printed with an expiration message.

The preferred embodiment supposes the use of a liquid crystal TN type display segment for output device 14. As shown in FIG. 8, a TN liquid crystal display device includes a clear plastic or glass display panel 14*a* containing an electrosensitive display media. The display media can assume two different states—dark and clear. If a quiescent voltage is applied to display panel 14*a*, the display media turns dark. Once the voltage is removed from display panel 14*a*, the media turns clear. In accordance with the present invention, a background 14*b* is applied to the rear surface of display panel 14*a*. As shown in FIG. 8, the "EXPIRED" message is printed on background 14*b*. When a voltage is applied to panel 14*a*, the display media obscures the EXPIRED message, and when the voltage is removed, the display media reveals the EXPIRED message.

In the TN display approach, the most significant bit ("MSB") of the 24 bit counter in FIG. 6 is the line used to power display 14 (pin 1 of counter 26*b*). A 24 bit counter can count to a total of 16,772,216 before overflowing and therefore starting over again from zero. The MSB must start out at a logic 1 to apply a voltage to the TN display. Initially, counter 26 is reset to zero and then loaded with 8,388,608 programming pulses, or one more than half of the total count. Counters 26*a*, 26*b* are reset to zero by a reset pulse generated by programming unit 32. The reset pulse is received by programming port 16, on pin 3. The reset pulse is then directed to the reset input (pin 11) of each of counters 26*a* and 26*b* via conductors 33 and 35, respectively. The 8,388,608 pulses are also generated by unit 32, and directed to counter 26*a* (pin 10) via port 16 and conductor 31.

Once counter 26 is set to the 8,388,608 count number, all bits except the MSB (pin 1 of counter 26*b*) are set to zero. The MSB is set to one, turning TN display 14 dark. Programming unit 32 calculates the remaining number of pulses needed to pre-load counter 26, by subtracting the time period to be timed (in # of pulses—e.g., using 20 seconds per pulse) from the second half of the available counts in counter 26 (i.e. 8,388,607). The number of pulses representing this difference is then programmed into counter 26, via conductor 31. The originally programmed number of 8,388,608 counts, plus this "difference" number, add up to what is referred to as the initial count number. The final count number in this TN display embodiment is 16,772,216, which is the number that will lower the MSB of counter 26 (pin 1 of counter 26*b*) to zero (i.e., overflow counter 26). In operation, counter 26 is incremented by pulses from pulse generator 24 until the overflow occurs (i.e., the desired time period expires), causing TN display 14 to reveal the "EXPIRED" message. The change of the MSB output from a high state (i.e., 5 volts) to a low state (i.e., zero), is an expiration signal, in this example, because it causes display 14 to reveal the "EXPIRED" message.

The TN display approach offers the advantage that if the battery prematurely fails, counter 26 will no longer work, and TN display 14 will revert back to a no-voltage condition by default and reveal the "EXPIRED" message. This message can be used to indicate battery failure as well as expired time. The article with which label 10 is associated, can be checked to determined whether the time period has truly expired. If it hasn't, it can be concluded that the battery has failed, or some other electrical failure has occurred. Thus, this approach provides some failure indication.

In the embodiment shown in FIG. 6, TN display 14 is actually operated in a "blinking" mode, upon overflow of counter 26. Logic gate 28 provides the means for such operation. For the TN display, gate 28 is an OR gate. As shown in FIG. 6, gate 28 is connected between TN display 14 and counter 26. One input of gate 28 is connected to the MSB of counter 26 (pin 1 of counter 26*b*), and the other input is connected to the least significant bit (LSB) of counter 26 (pin 9 of counter 26*a*). In an alternative arrangement, the other input of gate 28 may be connected directly to the output of generator 24, rather than to the LSB of counter 26. The output of gate 28 is connected directly to display 14. Gate 28 is powered by battery 19.

The pulse rate at the LSB output of counter 26 (pin 9 of counter 26*a*) is the same as pulse generator 24 (in this example, the rate is one pulse every 20 seconds). During the timing period (while the MSB output is high), the pulses from the LSB output are effectively ignored by OR gate 28, and the high MSB output appears at the output of gate 28 (causing TN display to remain dark). Once counter 26 overflows (timing period has expired), the MSB drops to zero, and the pulses from the LSB output appear at the output of OR gate 28. Thus, TN display 14 is made to "blink" between a dark state (high input) and a clear state (low input) upon expiration of the time period being timed.

The present invention is not limited to a blinking mode of operation. OR gate 28 can be eliminated from the circuit in FIG. 6 so that display 14 operates in a static mode, i.e., dark during timing and constantly clear upon expiration (constantly revealing the expiration message).

In a second embodiment, a solid state LED replaces the TN type display in FIG. 6. The LED requires no voltage until it is energized to indicate the expiration of a time period. If a blinking mode is desired, OR gate 28 (in FIG. 6)

is replaced with an AND gate. In the LED approach, counter 26 starts with all bits set at zero. This is accomplished by resetting counters 26*a* and 26*b*. Reset pulses are generated in programming unit 32 and transmitted to the reset inputs of counters 26*a* and 26*b* via conductors 33 and 35 respectively (See FIG. 6). In this example, the first half of counter 26's capacity (0–8,388,608 counts) is utilized instead of the last half as with the TN display approach. In this example, pulse generator 24 is configured to generate pulses at 4 second intervals. Since there are 31,536,000 seconds in a typical year, it would take up to 1.064 years to change the MSB of counter 26 from low to high. When this occurs, the LED is energized by the "high" voltage on the MSB output. This change from a low to a high state is referred to as the expiration signal in this example, because it causes the LED to be energized, indicating an expired condition.

If the LED is to be operated in a blinking mode, an AND gate is inserted between the LED and counter 26. In FIG. 6, OR gate 28 (used to operate TN display 14 in a blinking mode) is simply replaced with an AND gate. One input to the AND gate is taken from the MSB output (pin 1 of counter 26*b*) and the other input is taken from the LSB of counter 26 (pin 9 of counter 26*a*). Again, in an alternative arrangement, the other input to the AND gate can be taken from the output of pulse generator 24, rather than from the LSB of counter 26. The AND gate is powered by battery 19. During the time period being timed by label 10, the MSB output is low. Thus, the output of the AND gate remains low no matter what appears on the LSB output, and the LED remains off. Upon expiration of the period being timed, the MSB goes high, allowing the pulses from the LSB output to appear at the output of the AND gate. Thus, the LED is energized and de-energized in a periodic manner, i.e., the LED is operated in a blinking mode.

The present invention is not limited to an electronic display for indicating an expired condition. Any means for indicating an expired condition can be employed if some electrical transducer or interface can be devised for it. For example, the dye or chemical indicator technology disclosed in U.S. Pat. Nos. 4,408,557 to Bradley et al., 5,058,088 to Haas et al.; 5,182,212 to Jalinski; and 5,446,705 to Haas et al., may be employed with a transducer that causes the chemicals or dye to migrate upon receipt of an expiration signal from counter 26.

The present invention is not limited to visual means for indicating an expired condition. An audible signal may be employed instead, such as a speaker emitting a tone, or the sounding of a horn or buzzer.

As mentioned above, the process of determining the elapse time count is handled in programming unit 32. A computer program residing in unit 32, specifically designed for the task, asks for input as to the desired end date (i.e., date of expiration). It then takes the difference between the real date/time stored in it's clock and the desired end date. It then converts the difference into the correct number of pulses needed to realize this time interval. Programming unit 32 then calculates the correct number of programming pulses to send to label 10, as described above with reference to FIGS. 5 and 6. Once label 10 has been pre-loaded with the correct number of programming pulses, label 10 is removed from interface 34 and placed into service.

An example of one program that may be used in unit 32 to query the necessary data for calculating the correct number of programming pulses, is given as follows:

```
10 PRINT "SMART LABEL PROGRAMMER"
20 PRINT "Continue or Exit? (C or E)"
30 INPUT CORE$
40 IF CORE$="C" THEN GOTO 70
45 IF CORE$="c" THEN GOTO 70
50 IF CORE$="E" THEN GOTO 510
55 IF CORE$="e" THEN GOTO 510
60 GOTO 20
70 PRINT "CONNECT LABEL TO BE PROGRAMMED"
80 PRINT "press ENTER key when ready"
90 INPUT R
100 A$=DATE$
110 PRINT "CURRENT DATE IS" A$
120 YEAR$=RIGHT$(A$,4)
130 YY=VAL(YEAR$)
140 PRINT "ENTER YEAR OF EXPIRATION—(4 digits)
  —then press enter"
150 INPUT YYEXP
160 YYDIF=(YYEXP-YY)
170 YYDIF=(YYDIF*525600!)
180 REM YYDIF IS NOW IN MINUTES
190 PRINT YYDIF
200 MONTH$=LEFT$(A$,2)
210 MM=VAL(MONTH$)
220 PRINT "ENTER MONTH OF EXPIRATION—(01-12)
  —then press enter"
230 INPUT MMEXP
240 IF MMEXP<MM THEN MMEXP=(MMEXP+12)
250 MMDIF=(MMEXP-MM)
260 MMDIF=(MMDIF*43200!)
270 DAY$=MID$(A$,4,2)
280 DD=VAL(DAY$)
290 PRINT "ENTER DAY OF EXPIRATION—then press
  enter"
300 INPUT DDEXP
310 IF DDEXP<DD THEN DDEXP=(DDEXP+30)
320 DDDIF=(DDEXP-DD)
330 DDDIF=(DDDIF*1440)
340 COUNT=(DDDIF+MMDIF+YYDIF)
350 PRINT COUNT; "TOTAL MINUTES or"
360 ET=COUNT
370 ET=ET/60
380 PRINT ET; "HOURS UNTIL EXPIRATION"
390 PRINT "Now programming label—please wait"
400 FOR X=1 TO COUNT
410 LPRINT;
420 NEXT X
430 PRINT "Label programming complete"
440 PRINT "Continue or Exit? (C or E)"
450 INPUT S$
460 IF S$="C" THEN GOTO 10
470 IF S$="c" THEN GOTO 10
480 IF S$="E" THEN GOTO 510
490 IF S$="e" THEN GOTO 510
500 GOTO 440
510 END
```

Label 10 can be used in a number of different applications as indicated above. However, one particular important application involves a method of monitoring the shelf-life of a perishable product, such as a food or drug product. The first step in such a method is to affix label 10 to an application surface associated with the product. The application surface is preferably the container holding the food or drug product. Label 10 has been pre-programmed to time the shelf-life of the product. The next step is to time the shelf-life using the timer in label 10, and to generate an expiration signal upon the expiration of the shelf-life. As described above, in connection with the operation of label 10, the expiration signal is produced at the MSB output of counter 26. This output changes from either a high to a low level or from a low to a high level (depending on the display device used), causing display 14 to indicate an expired condition. The next step in the method is to indicate the expiration of the shelf-life using display 14, in response to the expiration signal. Finally, the method may further include the step of energizing the display 14 in a periodic manner, in response to the expiration signal, such that display 14 is made to blink on and off periodically upon the expiration of the shelf-life.

While the preferred embodiment of the invention has been particularly described in the specification and illustrated in the drawing, it should be understood that the invention is not so limited. Many modifications, equivalents, and adaptations of the invention will become apparent to those skilled in the art without departing from the spirit and scope of the invention as defined in the appended claims.

What is claimed is:

1. An electronic timing label for indicating the expiration of a time period associated with an article, said label comprising:

a pulse generator, configured to generate a series of pulses at a predetermined pulse rate;

a first binary counter having a clock input to which the series of pulses from said pulse generator are operatively coupled, said first counter having a most significant bit output;

a second binary counter having a clock input to which the most significant bit output of said first counter is operatively coupled, said second count having a most significant bit output, said first and said second counters being configured together as a two-stage binary counter which counts from an initial count number to a final count number in response to the series of pulses, the number of counts between the initial and final count numbers and the pulse rate being chosen to establish a counting time which corresponds to the time period associated with the article, the two-stage counter being configured to generate an expiration signal at the most significant bit output of said second counter upon reaching the final count number;

indicator means, operatively coupled to the most significant bit of said second counter, for indicating the expiration of the time period in response to the expiration signal;

a programming port, operatively coupled to the clock input of said first binary counter, for directing programing pulses to said first counter to preset the number of counts in the two-stage counter between the initial and final count numbers; and means for affixing said electronic timing label to an application surface associated with the article.

2. The electronic timing label of claim 1, further comprising a battery, operatively coupled to said pulse generator and to said first and said second binary counters.

3. The electronic timing label of claim 2, wherein said pulse generator, said first and said second binary counters, said indicator means, said programming port, and said battery are contained within a volume not exceeding about 1 cubic inch.

4. The electronic timing label of claim 1, wherein said indicator means is an electronic display device.

5. The electronic timing label of claim 4, wherein said electronic display device is a liquid crystal display.

6. The electronic timing label of claim 4, wherein said electronic display device is an LED which is energized in response to the expiration signal.

7. The electronic timing label of claim 5, wherein said liquid crystal display includes a background containing a visual expiration message, and further includes a display medium which substantially obscures the expiration message when energized and substantially reveals the expiration message when not energized, and wherein said liquid crystal display is normally energized, and is de energized in response to the expiration signal.

8. The electronic timing label of claim 6, further comprising means for energizing said LED in a periodic manner in response to the expiration signal, such that said LED is made to blink on and off periodically upon expiration of the time period associated with the article.

9. The label of claim 5, further comprising means for energizing said liquid crystal display in a periodic manner in response to the expiration signal, such that said display is made to blink on to obscure the expiration message and to blink off to reveal the expiration message.

10. The electronic timing label of claim 1, wherein said affixing means constitutes a permanent adhesive.

11. The electronic timing label of claim 1, wherein said affixing means constitutes double-sided tape.

12. An electronic timing label system comprising the electronic label of claim 1, and further comprising:

programming means for programming the two-stage binary counter, said programming means being configured to generate a predetermined number of programming pulses for setting the two-stage binary counter to the initial count number; and an interface, configured to be coupled between said programming means and the programming port of said label, whereby the programming pulses from said programming means pass through said interface and through the programming port of said label and are received by the clock input of said first binary counter.

13. An electronic timing label for indicating the expiration of a time period associated with an article, said label comprising:

a printed circuit board having front and rear mounting surfaces;

a pulse generator, mounted to said circuit board and being configured to generate a series of pulses at a predetermined pulse rate;

a binary counter, mounted to said circuit board and being operatively coupled to receive the series of pulses from said pulse generator, said counter being configured to count from an initial count number in response to the series of pulses and to generate an expiration signal upon reaching a final count number, the number of counts between the initial and final count numbers and the pulse rate being chosen to establish a counting time for said counter which corresponds to the time period associated with the article;

indicator means, operatively coupled to said counter, for indicating the expiration of the time period in response to the expiration signal generated by said counter;

a programming port, operatively coupled to said counter, for directing programming pulses to said counter to preset the number of counts in said counter between the initial and final count numbers; and a piece of double-sided tape having one side affixed to the rear mounting surface of said printed circuit board and another side free to be affixed to an application surface associated with the article.

14. The electronic timing label of claim 13, wherein said pulse generator and said binary counter are mounted to the front mounting surface of said printed circuit board.

15. The electronic timing label of claim 14, further comprising a cover mounted to said printed circuit board such that said pulse generator and said binary counter are enclosed by said cover.

16. The electronic timing label of claim 13, wherein the front and rear mounting surfaces of said printed circuit board have an area of not more than about 1.5 square inches.

* * * * *

UNITED STATES PATENT AND TRADEMARK OFFICE

CERTIFICATE OF CORRECTION

PATENT NO. : 5,802,015

DATED : Sept. 1, 1998

INVENTOR(S) : Alan W. Rothschild, et al

It is certified that error appears in the above-identified patent and that said Letters Patent is hereby corrected as shown below:

In col.11, line 31, "count" should read --counter.--

In col. 12, line 27, "electronic label" should read --electronic timing label--.

Signed and Sealed this

Twenty-ninth Day of December, 1998

*Attest:*

*Attesting Officer*

BRUCE LEHMAN

*Commissioner of Patents and Trademarks*